United States Patent [19]

Harrison et al.

[11] 4,145,003

[45] Mar. 20, 1979

[54] GUARD FOR POP-UP SPRINKLER

[75] Inventors: Richard J. Harrison, Delray Beach; William G. Muschett, Miami; Charles T. Hardy, Wilton Manors, all of Fla.

[73] Assignee: Safe-T-Lawn, Inc., Hialeah, Fla.

[21] Appl. No.: 828,250

[22] Filed: Aug. 26, 1977

[51] Int. Cl.[2] ..... B05B 1/28; B05B 15/10

[52] U.S. Cl. ..... 239/288; 239/204

[58] Field of Search ..... 239/203–206, 239/288, 288.5

[56] References Cited

U.S. PATENT DOCUMENTS

| | | | |
|---|---|---|---|
| 2,901,183 | 8/1959 | Kohl | 239/205 |
| 3,282,508 | 11/1966 | Roberts | 239/204 |
| 3,404,841 | 10/1968 | Brittain et al. | 239/204 |
| 3,567,125 | 3/1971 | Houghton | 239/204 |
| 3,874,595 | 4/1975 | Rindisbacher | 239/227 |

*Primary Examiner*—Robert W. Saifer

*Attorney, Agent, or Firm*—Eugene F. Malin; Barry L. Haley

[57] ABSTRACT

A one-piece flexible guard for excluding dirt and other foreign matter from the internal parts of a pop-up sprinkler. More particularly, a flexible circularly shaped piece of material which can be attached to the edge of the fixed housing assembly of a pop-up sprinkler. Said material having a circular hole in its center in which the pop-up sprinkler protrudes, said movable part being securely attached to said material along the edge of said circular hole. The guard being attached to the sprinkler in such a way so as to exclude foreign matter from the internal parts of the sprinkler while permitting the movable nozzle portion free vertical or horizontal movement. In an up position the outer perimeter of the guard forms a dam. The sprinkler also may provide fluid to wash the dirt from outside of the dam portion of the guard when the nozzle is in the extended or up position.

3 Claims, 2 Drawing Figures

Fig.1.
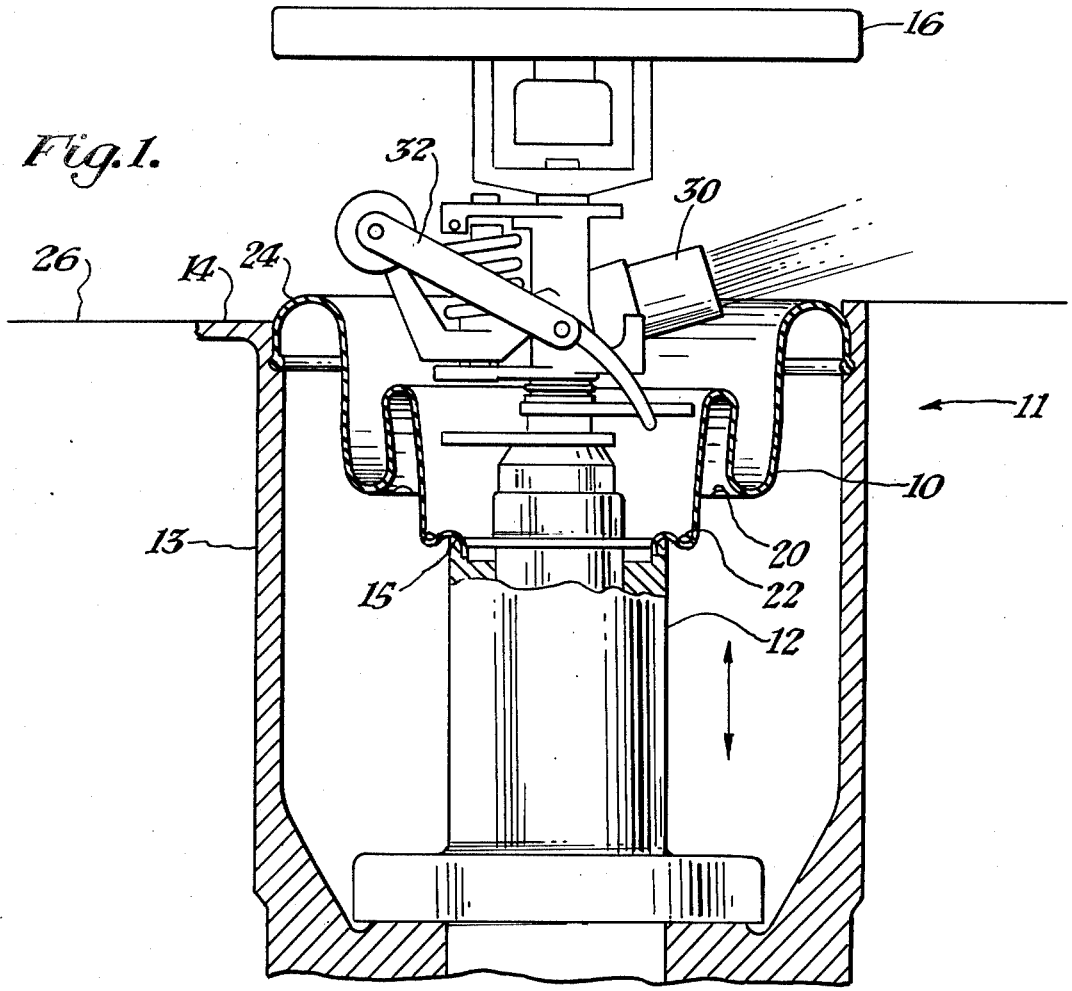
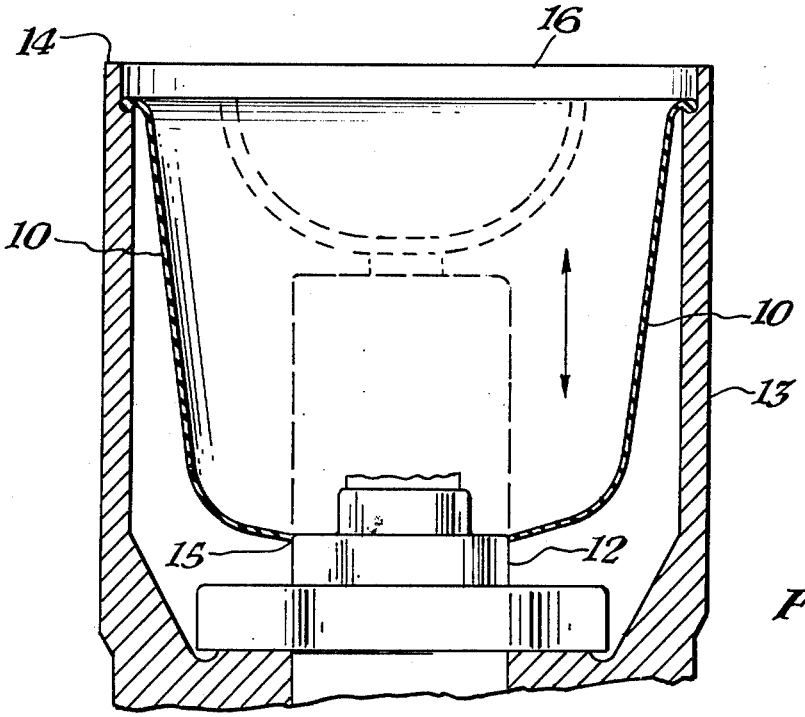
Fig.2.

GUARD FOR POP-UP SPRINKLER

BACKGROUND OF THE INVENTION

This invention relates to the field of barrier devices for pop-up sprinklers.

It has been found that pop-up sprinklers have the propensity to collect large quantities of foreign material in the housing due to water running back into said housing during the sprinkler operation. The housing fills with debris causing the sprinkler head to become inoperable or to become fixed permanently in the up position. To prevent this problem various types of seals have been developed. U.S. Pat. No. 3,921,910 to Hayes and Brunninga is for a recently developed pop-up sprinkler seal that does not exclude foreign matter from the top of sprinklers.

U.S. Pat. No. 3,874,595 to Rindisbacher discloses a guard, attached to a nozzle for horizontal type movement. This guard is not designed to collapse within the housing of the spraying device when the nozzle is in a retracted, inactive position. Nor does this device provide a dam structure. Since the nozzle in U.S. Pat. No. 3,874,595 does not retract and pop up, as in the present invention, the Rindisbacher guard may become caked with the build-up of foreign matter and thus fail to operate properly.

SUMMARY OF THE INVENTION

This invention relates to one piece flexible guard for excluding large quantities of dirt and other foreign matter from the internal parts of a pop-up sprinkler and for keeping dirt off the top of the sprinkler by a dam type structure. This guard is constructed in the manner of a "boot", having a portion rising with the piston portion of the sprinkler in a manner predetermined by its molded shape thereby causing a dam to form about the interface of the guard and the top of the housing. The dam eliminates the intrusion of large quantities of foreign matter into the sprinkler and creates a screening means to keep large foreign materials from entering the piston guide area of the sprinkler.

The primary object of this invention is to provide a guard for a pop-up sprinkler which keeps large foreign materials out of the housing assembly of the sprinkler.

Another object is to provide such a guard which will allow the pop-up assembly of the sprinkler to move vertically into and out of the housing and provide a dam means when in the upper position.

Another object is to provide such a guard which will collapsably fold into place below the top of the sprinkler when the piston nozzle portion of the sprinkler is in the lower position.

An additional object is to provide a guard having a dam portion that may be washed off by the fluid from the pop-up sprinkler when it is in an erect position.

These together with other objects and advantages will become apparent to those skilled in the art upon reading the details of construction and operation as more fully set forth hereinafter, reference being had to the accompanying drawings forming a part hereof, wherein like numerals refer to like parts throughout.

BRIEF DESCRIPTION OF THE DRAWINGS

FIG. 1 is a cross-section front view of the guard in place within a pop-up sprinkler in the upper position.

FIG. 2 is a cross-section front view of the guard in place with the pop-up sprinkler in a lower position.

DETAILED DESCRIPTION OF PREFERRED EMBODIMENTS OF THE INVENTION

Before the present device for screening out foreign matter from the internal parts of a pop-up sprinkler 11 is specifically described, it is to be understood that the invention is not limited to the particular arrangement of parts here shown, as such devices may vary. It is also to be understood that the phraseology or terminology herein used is for purposes of description and not of limitation, as the scope of the present invention is denoted by the appended claims.

Referring now to FIG. 1, the guard 10 is shown in place within one embodiment of a pop-up sprinkler 11 in an upper position. The guard 10 is shown in its relaxed position. The piston 12 is in the upper position in FIG. 1 and a lower position in FIG. 2. When the guard is released from the position shown in FIG. 2 it will move into the position shown in FIG. 1. The guard 10 is connected to the housing 13 near the top 14 of the housing 13, and to the piston 12 near the top 15 of the piston 12. The guard 10 is composed of a flexible water resistant material such as rubber or flexible plastic that is capable of withstanding prolonged exposure to the elements. The material must have a memory, and openings 20 and/or 22 may be provided in the lower fold regions, in FIG. 1.

When the piston 12 is in the lower position as illustrated in FIG. 2, the top sprinkler cover 16 of the sprinkler 11 is positionable on the top 14 of the housing 13. When the sprinkler 11 is in this closed position the guard 10 is positioned in the housing as shown in FIG. 2.

The guard 10 in its up position provides a dam 24 above the top surface 14 of the housing. The dam is all the way around the inside of the sprinkler top 14. Ground water that flows across the ground surface 26, engages the dam 24 and is directed away from the sprinkler 11. The nozzle 30 and the drive arm 32 provides irrigating water adjacent the dam 24. Drive arm moving into the stream or a break up means moving into the stream provides distribution of water near and on the guard 10. This irrigating water will move down surface 24 to wash away dirt from the dam 24 and top 14.

It should be noted that a movable ring in contact with the inside surface of housing 13 may be connected to the movable piston 12 to move up and down in the housing, not shown. This non-flexible member would provide a dam for the same purposes as dam 24.

The instant invention has been shown and described herein in what is considered to be the most practical and preferred embodiment. It is recognized, however, that departures may be made thereform within the scope of the invention and that obvious modifications will occur to a person skilled in the art.

What I claim is:

1. A guard in a piston type pop-up sprinkler having a pop-up head slidable in a piston guide and an outer casing having an upper rim comprising;

a flexible water resistant piece of material having a memory of a movable molded shape, said shape having a plurality of predetermined folds, said material having an outer perimeter and a central perimeter, a first means for connecting said outer perimeter to the upper portion of said outer casing of said piston type pop-up sprinkler, a second means for connecting said center perimeter guard to the slidable piston portion of said movable pop-up head in said pop-up sprinkler, said guard shaped by said memory to provide a flexible dam portion above said upper rim when said pop-up head is in the upper position to deflect ground water and a plurality of predetermined folds lower than said dam.

2. A guard in a piston type pop-up sprinkler having a pop-up head slidable in a piston guide and an outer casing having an upper rim as set forth in claim 1, wherein;

said material is flexible and movable into said upper position to form said predetermined folds from said memory to provide said dam portion.

3. A guard in a piston type pop-up sprinkler having a pop-up head slidable in a piston guide and an outer casing having an upper rim as set forth in claim 2, wherein;

a pluraltity of apertures are provided in the lower folds in said material when said guard is in said upper position for drain purposes, said flexible material movable to a second position within said outer casing when said piston type pop-up sprinkler is in a lower retracted position.

* * * * *